US005220244A

United States Patent [19]

Maseki et al.

[11] Patent Number: 5,220,244

[45] Date of Patent: Jun. 15, 1993

[54] METAL HALIDE DISCHARGE LAMP

[75] Inventors: Kyoichi Maseki, Gyoda; Masao Niijima, Kumagaya; Akira Urushihara, Fukaya; Shinya Suzuki; Kazushi Tominaga, both of Gyoda, all of Japan

[73] Assignee: Iwasaki Electric Co. Ltd., Tokyo, Japan

[21] Appl. No.: 798,059

[22] Filed: Nov. 27, 1991

Related U.S. Application Data

[63] Continuation of Ser. No. 527,410, May 23, 1990, abandoned.

[30] Foreign Application Priority Data

May 31, 1989 [JP] Japan ..... 1-135950
Nov. 29, 1989 [JP] Japan ..... 1-307490

[51] Int. Cl.[5] ..... H01J 61/073; H01J 61/18; H01J 61/30

[52] U.S. Cl. ..... 313/620; 313/634; 313/640; 313/641

[58] Field of Search ..... 313/640, 641, 620, 634

[56] References Cited

U.S. PATENT DOCUMENTS

| | | | |
|---|---|---|---|
| 3,319,119 | 5/1967 | Rendina | 313/161 X |
| 3,334,261 | 8/1967 | Butler et al. | 313/641 |
| 3,654,506 | 4/1972 | Kuhl | 313/184 |
| 3,786,297 | 1/1974 | Zollweg et al. | 313/640 |
| 4,161,672 | 7/1979 | Cap et al. | 313/634 X |
| 4,171,498 | 10/1979 | Fromm et al. | 313/641 |
| 4,206,387 | 6/1980 | Kramer et al. | 313/641 X |
| 4,801,846 | 1/1989 | Kramer et al. | 313/641 |
| 4,910,432 | 3/1990 | Brown et al. | 313/620 |
| 4,935,668 | 6/1990 | Hansler et al. | 313/620 X |
| 5,101,134 | 3/1992 | Rothwell, Jr. | 313/634 X |

FOREIGN PATENT DOCUMENTS

| | | | |
|---|---|---|---|
| 0342762 | 11/1989 | European Pat. Off. . | |
| 41875 | 11/1974 | Japan | 313/641 |
| 54-22973 | 2/1979 | Japan . | |
| 2030762A | 4/1980 | United Kingdom . | |

*Primary Examiner*—Palmer C. DeMeo
*Attorney, Agent, or Firm*—Armstrong, Westerman, Hattori, McLeland & Naughton

[57] ABSTRACT

A metal halide lamp of the present invention comprises a luminous tube alone without any outer bulb, the luminous tube containing metal halides such as neodymium halides ($NdX_3$), dysprosium halides ($DyX_3$) and cesium halides (CsX) in a total amount by mole of $1\times10^{-6}$ to $8\times10^{-6}$ mol/cc and the following molar ratios:

$$0.2 \leqq \frac{NdX_3}{DyX_3} \leqq 1$$

$$0.08 \leqq \frac{NdX_3 + DyX_3}{CsX} \leqq 2.5$$

as well as rare gas serving as starting auxiliary gas and mercury serving as buffer gas. This structure permits a predetermined vapor pressure of the metal halides sealed in the luminous tube to be obtained without increasing the wall load, as well as the formation of a metal halide lamp having a long life and good color characteristics.

4 Claims, 5 Drawing Sheets

METAL HALIDE DISCHARGE LAMP

This application is a continuation of application Ser. No. 527,410 filed May 23, 1990, now abandoned.

BACKGROUND OF THE INVENTION

The present invention relates to a metal halide lamp, and particularly to a small metal halide lamp which is lighted only by a luminous tube without any outer bulb and which has excellent spectral distribution properties.

Small metal halide lamps, each of which is provided with a luminous tube without an outer bulb, are generally used as light sources for overhead projectors (OHP) and moving picture projectors and are gradually popularized. In each of such small metal halide lamps, the low vapor pressure of the metal halides sealed in the luminous tube is increased by increasing the wall load on the luminous tube so that desired emission can be obtained.

In each of the metal halide lamps having no outer bulb, the wall load on the luminous tube is increased by reducing the size of the luminous tube so that the low vapor pressure of the metal halide is increased. The quartz tube used as the luminous tube is thus devitrified owing to heat or deformed to expand. The metal halide lamps without any outer bulb have a problem with respect to their life which is shorter than that of lamps with outer bulbs.

Of this kind of lamps, dysprosium-thallium (Dy-Tl) lamps have excellent color characteristics such as color temperature and color rendering but show chromaticity coordinates on a X-Y chromaticity diagram (referred to as "chromaticity coordinates" hereinafter) which significantly deviate from the blackbody locus. The Dy-Tl lamps are therefore unsuitable as light sources for overhead projection-type televisions (referred to as "OHP-type TV light source" hereinafter).

SUMMARY OF THE INVENTION

It is an object of the present invention to provide a metal halide lamp without any outer bulb which has none of the problems of conventional metal halide lamps.

It is another object of the present invention to provide a metal halide lamp without any outer bulb which has a long life and excellent color characteristics and which can be used as an OHP-type TV light source.

In order to achieve the objects, the present invention provides a metal halide lamp comprising only a luminous tube without any outer bulb, the luminous tube having main electrodes at least at both ends thereof and containing metal halides consisting of a neodymium halide ($NdX_3$), a dysprosium halide ($DyX_3$) and a cesium halide (CsX) in a total amount by mole of $1\times10^{-6}$ to $8\times10^{-6}$ mol/cc and the following molar ratios:

$$0.2 \leqq \frac{NdX_3}{DyX_3} \leqq 1$$

$$0.08 \leqq \frac{NdX_3 + DyX_3}{CsX} \leqq 2.5$$

as well as rare gas serving as auxiliary starting gas and mercury serving as buffer gas.

The above structure permits the metal halides sealed to have a predetermined vapor pressure without increasing the wall load on the luminous tube. It is therefore possible to prevent a deformation of the luminous tube and easily obtain a metal halide lamp having a long life and good color characteristics.

DESCRIPTION OF PREFERRED EMBODIMENTS

Embodiments of the present invention are described below with reference to the drawings.

Figure 1:
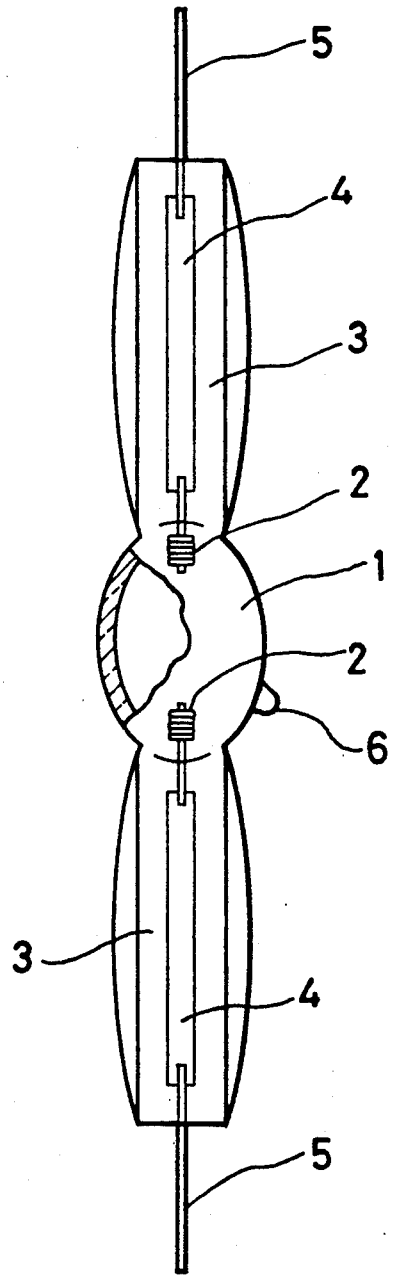
FIG. 1 is a drawing of an embodiment of a metal halide lamp in accordance with the present invention.

FIG. 1 is a drawing of a first embodiment of a metal halide lamp in accordance with the present invention. In the drawing, reference numeral 1 denotes a quartz discharge tube which has a substantially elliptical sectional form, a maximum internal diameter of 9 mm, a maximum external diameter of 11 mm and a content volume of about 0.6 cc. Electrodes 2 are respectively connected to the molybdenum foils 4 provided in sealing parts 3 at both ends of the discharge tube 1. Each of the electrodes 2 comprises a tungsten rod, which has a diameter of 0.5 mm and a length of 6.5 mm and which contains 1.7% of thorium oxide ($ThO_2$), and a coil of a tungsten wire having a diameter of 0.35 mm which is wound around the tungsten rod so as to have a length of 2.5 mm and a distance of 0.3 mm or more from the top of the tungsten rod. The gap between the two electrodes 2 is set to 7.5 mm. Reference numeral 5 denotes external molybdenum lead wires which are respectively connected to the molybdenum foils 4, and reference numeral 6 denotes the chipped-off portion of an evacuating pipe.

Figure 2:
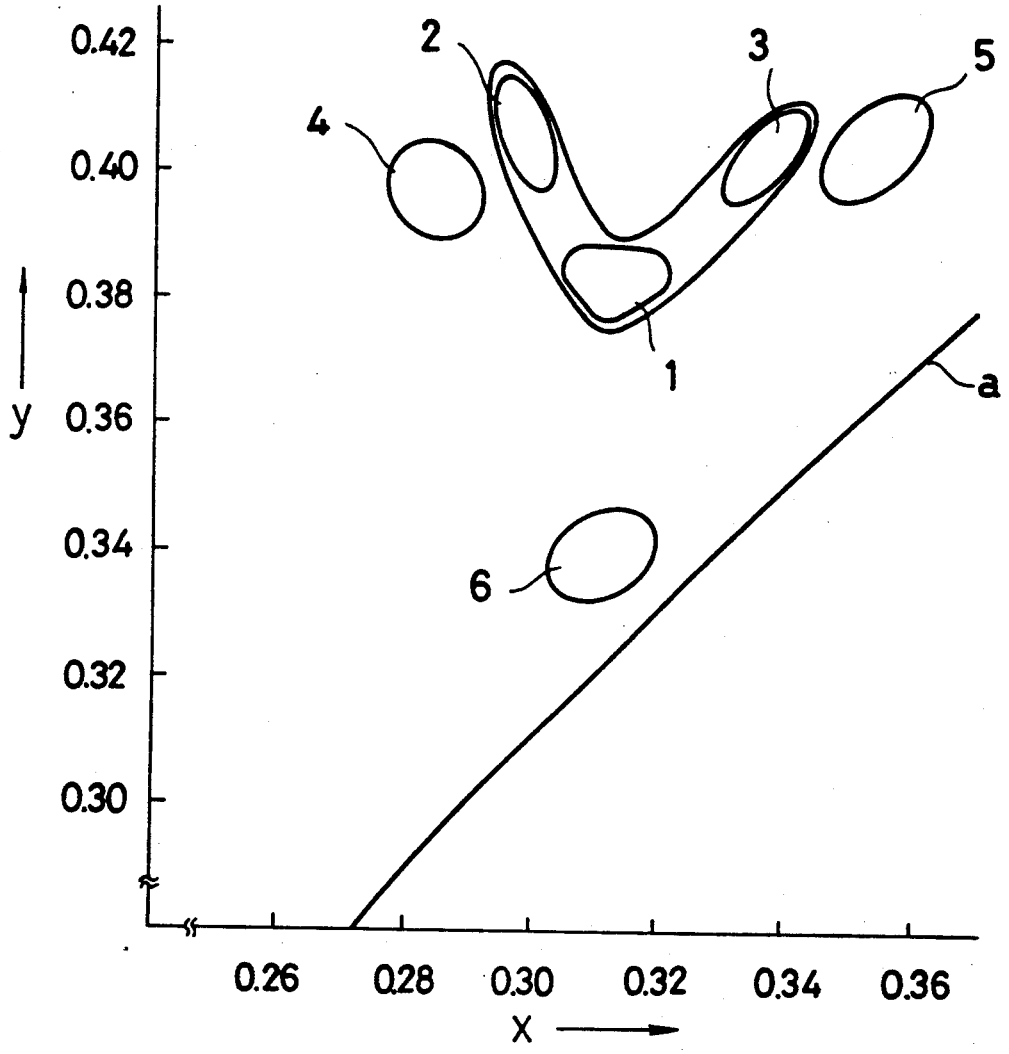
FIG. 2 PRIOR ART
FIG. 2 is a X-Y chromaticity diagram which shows changes in chromaticity coordinates of a lamp comprising a luminous tube in which Dy-Tl additives are sealed.

In this embodiment, in order to prevent the deformation of the luminous tube configured as described above and improve the color characteristics thereof, metal iodides are used as the metal halides sealed in the luminous tube. The kinds and amounts of the metal iodides are as follows:

In setting the kinds and amounts of metal iodides to be sealed, the inventors made the following experiments: 0.4 mg of a mixture of dysprosium iodide ($DyI_3$) and cesium iodide (CsI) in a ratio by weight of 2:1, i.e., a molar ratio of 0.8:1, 0.2 mg of thallium iodide (TlI), mercury (Hg) serving as buffer gas and argon (Ar) serving as auxiliary starting gas were sealed in a luminous tube having the above structure to form a lamp with a lamp voltage of 90 V and a lamp power of 150 W on an experimental basis. When the color characteristics of the lamp formed were examined, the color temperature was 6500K, the color rendering index Ra was 85, and the chromaticity coordinates (x, y) were (0.31, 0.38). The chromaticity coordinates deviated from the blackbody locus a in the X-Y chromaticity diagram, as shown by region (1) in FIG. 2. It is thus found that the lamp serves as a greenish light source having a good color.

Since it was thought that the deviation of the the chromaticity coordinates of the lamp formed is caused by the large content volume of the luminous tube, changes in chromaticity coordinates with changes in lamp power input to the luminous tube were measured. As a result, it was found that, although the chromaticity coordinates are moved to region (2) and region (3) when the lamp power is decreased to 120W and increased to 180W, respectively, in either case, the chromaticity coordinates are not moved near to the blackbody locus a. Experiments were also carried out for measuring changes in the total amount of the additives sealed at a constant ratio between $DyI_3$-CsI and TlI and a constant lamp power. As a result, it was found that the chromaticity coordinates are moved to region (4) and region (5) when the amount is reduced to ⅛ and increased to 4 times, respectively, but they are not moved near to the blackbody locus a.

A lamp was then formed with a ratio between the metal iodide additives which was changed so that the total amount of $DyI_3$ and CsI in a molar ratio of 0.8:1 was 1.6 mg, and the amount of TlI was 0.2 mg. The chromaticity coordinates (x, y) measured were (0.31, 0.34). The lamp obtained thus had substantially desired color characteristics, as shown by region (6) in FIG. 2. However, when light was actually projected on a screen by using the lamp as an OHP-type TV light source, irregularity of yellow color occurred in the image projected to the screen owing to the selective light absorption by the additives. It was thus found that the lamp is unsuitable for practical use.

Figure 3:
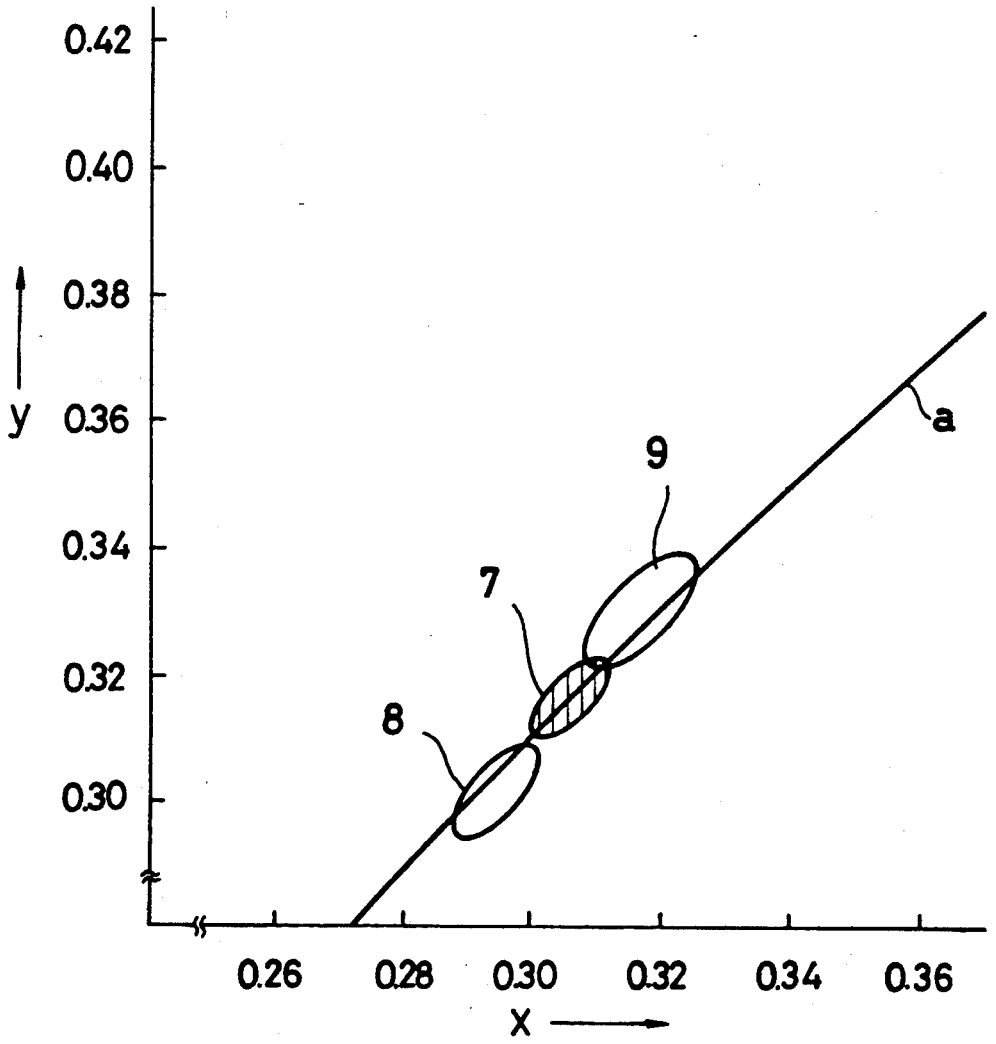
FIG. 3 is a X-Y chromaticity diagram which shows changes in chromaticity coordinates with changes in input lamp power of a lamp in which Dy-Nd iodide additives are sealed in accordance with the present invention.

The kinds of the substances sealed were thus changed. Namely, 0.4 mg of $DyI_3$ and CsI in a molar ratio of 0.8:1, 0.2 mg of neodymium iodide ($NdI_3$) and CsI in the same molar ratio of 0.8:1, mercury and argon gas were sealed in a luminous tube having the same size as that described above to form a lamp (rating, 150 W). When the color characteristics of the lamp formed were measured, in most cases, the color temperature was 7000K, the index Ra was 91 and the chromaticity coordinates (x, y) were (0.305, 0.317). The lamp obtained can be therefore used as a light source having chromaticity coordinates which substantially approximate to the blackbody locus a , as shown by region (7) in FIG. 3. When light was actually projected on a screen by using as an OHP-type TV light source the lamp formed, substantially no color absorption caused by the additives sealed was observed. It was thus found that the lamp obtained can be used as a light source generating uniformity in color.

On the basis of the results, $DyI_3$, $NdI_3$ and CsI were used as metal iodide additives to be sealed in the metal halide lamp of the present invention.

When the starting test of the lamp was carried out, it was confirmed that the lamp can be started at a starting voltage which is lower than that of the Dy-Tl lamp in which 1.6 mg of $DyI_3$-CsI and 0.2 mg of TlI are sealed. This was caused by a small amount of impurities gas mixed in the lamp during actual sealing of the additives which adversely affect the starting properties owing to a low ratio of the total amount of the additives sealed to the content volume of the luminous tube.

Further, changes in chromaticity coordinates with changes in lamp power of a Dy-Nd luminous tube in which the same additives as those described above were sealed were measured by changing the lamp power to 120 W and 180 W. As a result, it was found that the chromaticity coordinates are moved along the blackbody locus, as compared with the above-described Dy-Tl lamp, and do not much deviate from the blackbody locus a, as shown by regions (8) and (9) in FIG. 3. This fact reveals that the use of the Dy-Nd additives sealed permits the formation of a light source having chromaticity coordinates approximating to the blackbody locus regardless of the size of the luminous tube, i.e., even if the content volume of the luminous tube is increased so that the wall load is decreased.

Figure 4:
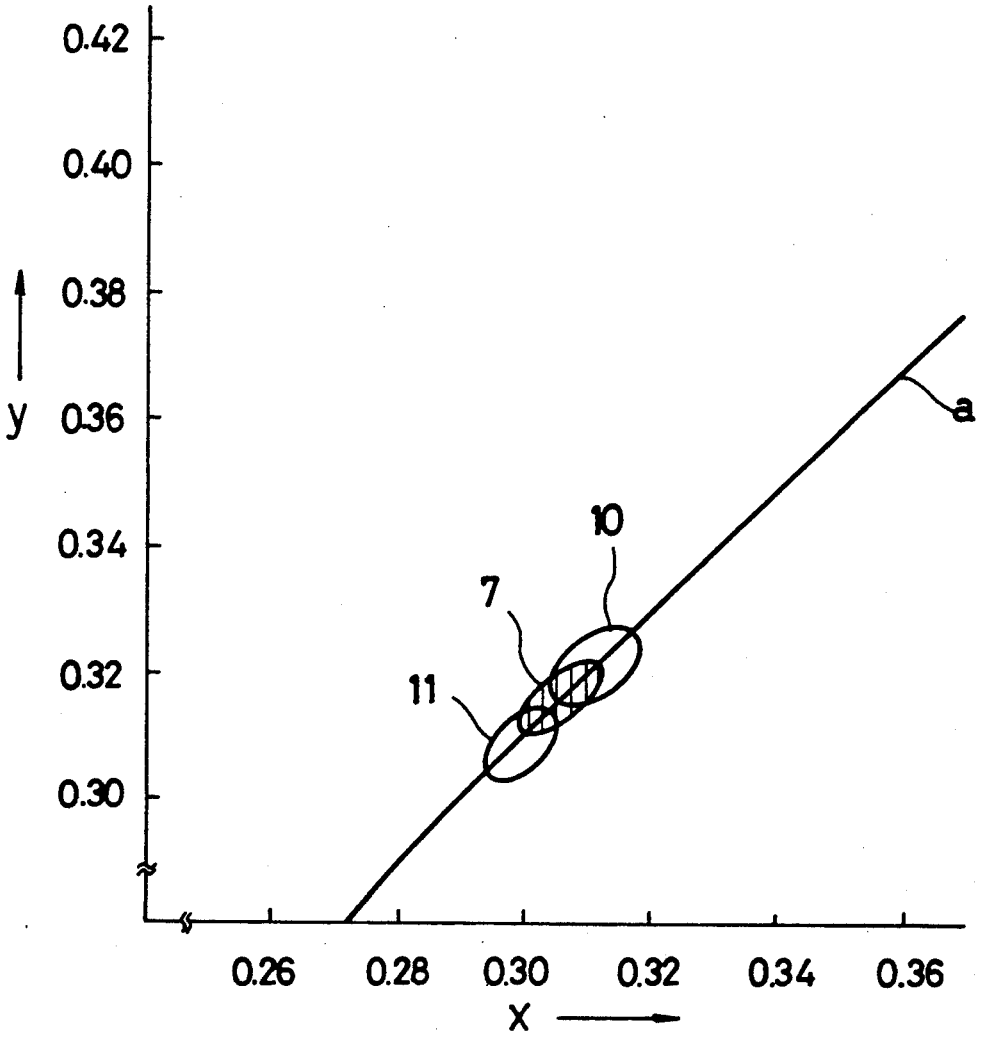
FIG. 4 is a X-Y chromaticity diagram which shows changes in chromaticity coordinates with changes in the amounts of the same Dy-Nd iodide additives sealed in a lamp.

In addition, lamps were respectively formed by using luminous tubes which had the same size and in which the above-described amounts of the $DyI_3$-CsI (0.4 mg in a molar ratio of 0.8:1) and $NdI_3$-CsI (0.2 mg in a molar ratio of 0.8:1) were doubled and halved. When the lamps formed were subjected to measurements of chromaticity coordinates (x, y), it was confirmed that the lamps formed show changes in chromaticity coordinates substantially on the blackbody locus a, as shown by regions (10) and (11) in FIG. 4.

As described above, it was found that, since high vapor pressure is obtained in the Dy-Nd lamp, the lamp obtained exhibits chromaticity coordinates approximating to the blackbody locus and a little irregularity of color even if the amounts of the additives is slightly changed in the luminous tube having a relatively large size, or even if the lamp power is changed due to the lamp voltage and a ballast. It was thus found that the lamp obtained is suitable as an OHP-type TV light source.

When a lamp comprising a luminous tube, which had an external diameter of 12 mm, an internal diameter of 9.8 mm, an arc length of 5 mm and a content volume of 0.5 cc, was also formed and subjected to measurements of color characteristics, the similar results to those described above were obtained.

In regard to the ratios of the amounts of Dy-Nd additives sealed in the above lamp, if the amount of $NdI_3$ sealed exceeds the amount of $DyI_3$ sealed and if the molar ratio therebetween exceeds 1, since the blue component in the luminous region is increased, the Ra value is decreased, and the color temperature is significantly increased, the lamp formed is unsuitable as an OHP-type TV light source. While if the amount of $DyI_3$ sealed is greater than the amount of $NdI_3$, and if the molar ratio of $NdI_3$ to $DyI_3$ is less than 0.2, since the vapor pressure of $DyI_3$ is also decreased owing to a decrease in the vapor pressure of NdI3, the blue component in the luminous region is increased, the Ra value is decreased, and the color temperature is increased, the lamp formed is unsuitable as an OHP-type TV light source.

In regard to the ratios of the amounts of the Dy-Nd additives sealed, if the total amount of $NdI_3$ and $DyI_3$ is increased to a value greater than that of CsI so that the molar ratio of $NdI_3$-$DyI_3$ to CsI exceeds 2.5, since the color temperature is decreased, and the arc sways and gives a disagreeable impression on the irradiation surface, the lamp formed is undesirable. While if the amount of $NdI_3$ and $DyI_3$ is reduced so that the molar ratio thereof to the amount of CsI sealed is less than 0.08, since the vapor pressure is decreased, the radiation in the blue range is increased, the Ra value is decreased and the color temperature is increased, the lamp formed is unsuitable as a light source.

The appropriate ranges of the molar ratios of NdI3, $DyI_3$ and CsI are therefore the following:

$$0.2 \leqq \frac{NdI_3}{DyI_3} \leqq 1$$

$$0.08 \leqq \frac{NdI_3 + DyI_3}{CsI} \leqq 2.5$$

It is also preferable that the total amount of the additives sealed is $1\times10^{-6}$ to $8\times10^{-6}$ mol/cc. The reason for this is that, if the total amount is less than $1\times10^{-6}$ mol/cc, the Dy atomic emission is increased, and, consequently, the blue region is increased, and the red region is decreased, and that, if the total amount exceeds $8\times10^{-6}$ mol/cc, the vapor pressure is excessively increased, and the arc is thus swayed in some cases.

A description will now be given of an embodiment which employs metal bromides as metal halides to be sealed in a luminous tube.

In this embodiment, the luminous tube used had the same structure as that in the first embodiment shown in FIG. 1 and contained metal bromides whose kinds and amounts were established as described below for the purpose to preventing a deformation in the luminous tube and improving the color properties thereof in the same way as in the first embodiment.

0.3 mg of a total amount of dysprosium bromide ($DyBr_3$) and cesium bromide (CsBr) in a molar ratio of 1:1, 0.15 mg of a total amount of neodymium bromide ($NdBr_3$) and cesium bromide (CsBr) in a molar ratio of 1:1, mercury and argon were sealed in the luminous tube to form a lamp with rating of 150 W. When the color characteristics of the lamp were measured, in most cases, the lamp exhibited a color temperature of 6800K, a Ra value of 92 and chromaticity coordinates (x, y) of (0.31, 0.32). It was found from the results that the lamp has chromaticity coordinates which approximates to the blackbody locus a, as shown by region (12) in FIG. 5 . When light was actually projected on a screen by using a parabolic mirror, there was substantially no color absorption by the additives sealed. It was found from this that the lamp obtained is a light source generating uniformity in color.

Figure 5:
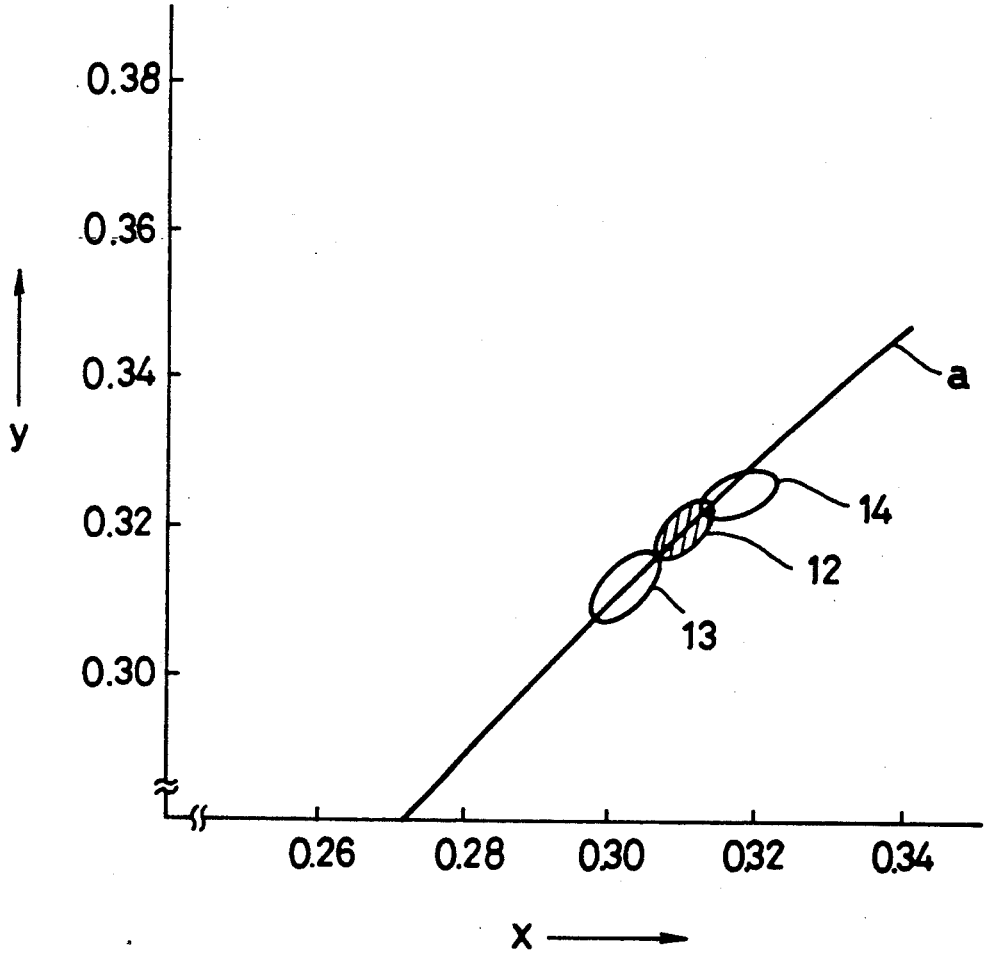
FIG. 5 is a X-Y chromaticity diagram which shows changes in chromaticity coordinates with changes in input lamp power of a lamp in which Dy-Nd bromide additives are sealed in accordance with the present invention.

In addition, when changes in chromaticity coordinates with changes in lamp power were measured by changing the lamp power to 120 W (−20%) and 180 W (+20%), it was found that the chromaticity coordinates are moved to regions (13) and (14) in FIG. 5 with changes by −20% and +20%, respectively, with producing substantially no deviation from the blackbody locus a. Further, the amounts of $NdBr_3$-CsBr (0.3 mg in a molar ratio of 1:1) and $NdBr_3$-CsBr (0.15 mg in a molar ratio of 1:1) were doubled and halved to form lamps. When the color characteristics of the lamps formed were measured, the chromaticity coordinates of the lamps were changed to regions which were substantially the same as the regions (13) and (14) shown in FIG. 5 produced when the lamp power was changed. It was thus confirmed that the lamps formed show changes in chromaticity coordinates approximating to the blackbody locus a.

When investigation was made on appropriate ratios between $NdBr_3$ and $DyBr_3$ and between ($NdBr_3$+$DyBr_3$) and CsBr, it was found that ratios within the same ranges as those in the first embodiment are suitable. Namely, the ratios in terms of molar ratio are the following:

$$0.2 \leqq \frac{NdBr_3}{DyBr_3} \leqq 1$$

$$0.08 \leqq \frac{NdBr_3 + DyBr_3}{CsBr} \leqq 2.5$$

It was also confirmed that the appropriate range of the total amounts of the additives is $1\times10^{-6}$ to $8\times10^{-6}$ mol/cc in the same way as in the first embodiment.

In this embodiment which uses bromides as halides, the vapor pressure can be more increased than in the first embodiment in which only iodides are sealed. This embodiment therefore permits an increase in the size of the discharge tube which forms the luminous tube when the size of a light source is not limited and an attempt to be made to increase the life of a lamp.

Although each of the embodiments uses as halide additives to be sealed iodides ($NdI_3$, $DyI_3$, CsI) or bromides ($NdBr_3$, $DyBr_3$, CsBr), it was confirmed that the use of mixtures of iodides and bromides produces the same operational effect as that of the other embodiments.

As described above on the basis of the embodiments, the present invention permits a light source, which is suitable as an OHP-type TV light source and which has chromaticity coordinates approximating to the blackbody locus, to be obtained by appropriately selecting additives for the luminous tube from neodymium halides, dysprosium halides, cesium halides and setting appropriate ratios and sealing amounts thereof even if the luminous tube has a relatively large size and the input power or the amounts of the additives sealed vary to some extent. The present invention also permits a decrease in wall load and thus the formation of a metal halide lamp having a long life and good spectral characteristics.

While the invention has been particularly shown and described in reference to preferred embodiments thereof, it will be understood by those skilled in the art that changes in form and details may be made therein without departing from the spirit and scope of the invention.

We claim:

1. A metal halide lamp comprising:

a luminous tube absent an outer bulb; and main electrodes projecting from at least opposing ends of said luminous tube with a predetermined gap between said main electrodes, and luminous tube containing metal halides such as, neodymium halides ($NdX_3$), dysoprosium halides ($DYX_3$) and cesium halides (CsX) in a total amount by mole of $1\times10^{-6}$ to $8\times10^{-6}$ mol/cc and in the following molar ratios:

$$0.2 \leqq \frac{NdX_3}{DyX_3} \leqq 1$$

$$0.08 \leqq \frac{NdX_3 + DyX_3}{CsX} \leqq 2.5; \text{ and}$$

rare gas for serving as auxiliary starting gas and mercury serving as buffer gas, and said luminous tube having a sectional form which is substantially elliptical with an internal diameter of at most 9.8 mm, an external diameter of at most 12 mm, and a content volume of at most 0.6 cc, wherein a gap between said main electrodes is between 5 mm and 7.5 mm, and wherein a lamp power of said metal halide lamp is between 120 W and 180 W.

2. A metal halide lamp according to claim 1, wherein said metal halides to be sealed in said metal halide lamp are metal iodides.

3. A metal halide lamp according to claim 1, wherein said metal halides to be sealed in said metal halide lamp are metal bromides.

4. A metal halide lamp according to claim 1, wherein said metal halides to be sealed in said metal halide lamp are mixtures of metal iodides and metal bromides.

* * * * *